US005115797A

United States Patent [19]

Hurner

[11] Patent Number: 5,115,797

[45] Date of Patent: May 26, 1992

[54] STOVE TOP COVER FOR A MOBILE VEHICLE STOVE

[76] Inventor: Wes D. Hurner, R.R. 2, Box 289, Glyndon, Minn. 56547

[21] Appl. No.: 726,240

[22] Filed: Jul. 5, 1991

[51] Int. Cl.[5] ..... F24C 15/10; 126 211

[52] U.S. Cl. ..... 126/214 R; 108/50; 126/315

[58] Field of Search ..... 126/211, 214 R, 221, 126/215; 108/50, 42

[56] References Cited

U.S. PATENT DOCUMENTS 2,696,812 12/1954 Merritt ..... 126/214 R 4,361,132 11/1982 Adkins ..... 126/221

*Primary Examiner*—Carroll B. Dority

*Attorney, Agent, or Firm*—Charles C. Corbin

[57] ABSTRACT

Disclosed is a cover for the top of a stove used in a mobile vehicle, the stove top having several gas-burners and support racks removably mounted around the burners for supporting cooking utensils thereover, and each support rack having a central opening therein, and the cover including a generally rectangular platform and a plurality of abbreviated legs projecting downwardly from the bottom of the platform, whereby the cover may be placed over the stove top with the legs received in releasably binding engagement with the central openings of the support racks, so as to support the platform and to hold the support racks against undesirable rattling and vibration.

8 Claims, 1 Drawing Sheet

STOVE TOP COVER FOR A MOBILE VEHICLE STOVE

BACKGROUND OF THE INVENTION

1. Field of the Invention

The present invention relates to covers for stoves used in mobile vehicles, and more particularly relates to a stove-top cover that engages the cooking utensil support racks that surround the burners.

2. Description of the Prior Art

Gas-fueled stoves form a popular furnishing of mobile vehicles such as recreational vehicles (RVs), camping trailers and recreational vans. Typically such a conventional stove has a four-burner stove-top arrangement that includes a cooking utensil support rack that is removably mounted around each of the burners. While the mobile stove is obviously highly desirable and advantageous there are some limitations and drawbacks associated with their use. For example, the stove-top ordinarily does not lend itself to be used for storing or supporting various articles when the stove is not used for cooking, which is an important consideration in a spatial environment where efficient and effective use of available space is highly desirable. A further drawback is that in many cases, when the vehicle is in motion, an annoying rattling and vibration of the support racks can occur. Although some attempts have been made to reduce the problem concerning the cooking utensil support rack, a satisfactory solution has yet to be made available for both the rattling problem and the lack of a suitable storage platform.

SUMMARY OF THE INVENTION

In view of the foregoing it is a general object of the present invention to provide an improved cover for a RV stove top.

Another object of the present invention is to provide means to prevent annoying vibration and rattling of the cooking utensil support racks on the stove-top of a RV stove.

A still further object of the present invention is to provide a stove-top cover that both secures stove-top support racks against vibrations, as well as provides a useful storage platform at the stove-top.

Yet another object is to provide such a stove-top cover that is simple and easy to use, and which lends itself to economic fabrication so as to be commercially available at a reasonable price.

These and other objects and advantages are provided by the present invention of a cover for the stove-top of a mobile vehicle stove, and the stove-top having a plurality of burners and associated cooking utensil racks, and the cover including a generally rectangular platform having a generally flat top surface adapted to support articles thereupon, and a plurality of abbreviated legs projecting downwardly from the bottom of the platform. Each of the utensil support racks has a central opening therein and the cover feet are spaced apart from each other such that they together may be brought into registration with the support rack central openings. In a preferred embodiment each leg is generally cylindrical and has a portion that is tapered, with a generally rigid core covered by an outer sheath of an elastomer, shock-dampening material. Each leg is adapted to be received in the central opening of a support rack and to make snug, removably binding frictional engagement therein, whereby the cover according to the invention may be placed over the stove-top with its plurality of feet engaging the plurality of stove-top racks to support the platform, to hold the racks against lateral and vertical vibration, and to provide a usable storage surface.

BRIEF DESCRIPTION OF THE DRAWINGS

The accompanying drawings, which are incorporated in and form a part of the specifications, illustrate a preferred embodiment of the present invention and together with the description serve to explain the principles of the invention, wherein.

DETAILED DESCRIPTION OF THE INVENTION

Figure 1:
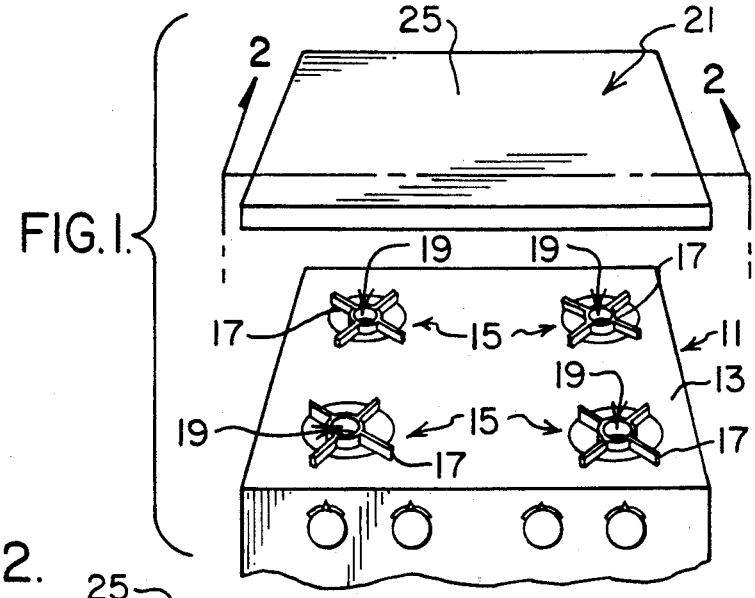
FIG. 1 is a partial, frontal perspective view of a preferred embodiment of a stove-top according to the present invention.
Figure 2:
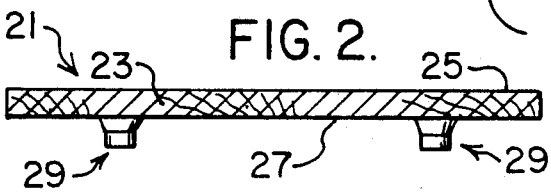
FIG. 2 is a sectional view taken along the line 2—2 of FIG. 1.

Referring now to the drawings, FIG. 1 shows the upper stove-top portion of a typical four-burner gas-fueled mobile stove 11 which includes a top surface 13 and, in association with the burners, four conventional cooking utensil support frames 15, each frame 15 having support arms 17 that extends radially from a generally circular central opening 19. The support frames 15 are of the type having downward projections (not shown) that engage openings in the top surface 13 for removably mounting them, and to allow easy removal as desired for cleaning and maintenance. It is noted that although there is a variety of stove-top utensil support frames currently commercially available, they all have in common a central opening that is effectively circular in configuration.

Figure 3:
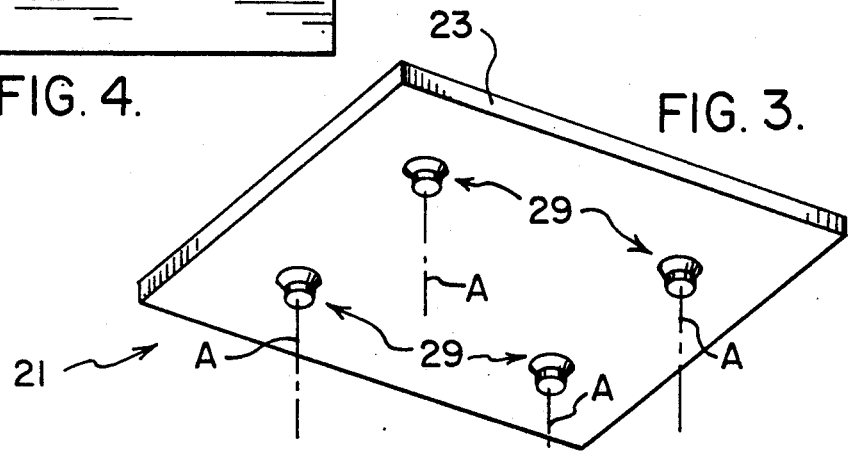
FIG. 3 is a bottom perspective view of a stove-top cover according to the present invention.

FIGS. 1 and 3 illustrate a preferred embodiment of the invention in the form of a stove-top cover 21 that includes a generally rectangular platform 23 that provides an upper surface 25 and a lower surface 27. Platform 23 is dimensioned so that it will completely cover the stove-top 13 when applied thereover in a manner to be described. In this preferred embodiment the platform 23 is constructed of wood, with wooden strips laminated in side-by-side relationship in a conventional manner to provide durability, style and attractiveness. Of course the invention is not limited to a slab having this construction, and it will be apparent to those with ordinary skill in the art, that other equivalent material may be suitable.

Figure 5:
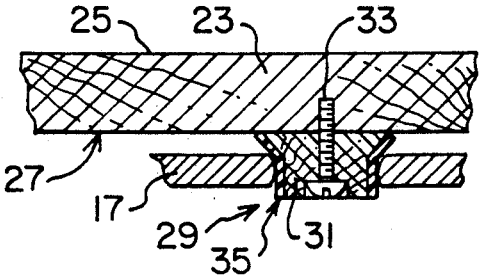
FIG. 5 is an enlarged partial, sectional view illustrating the mounting of a leg of a stove-top cover according to the invention.
Figure 4:
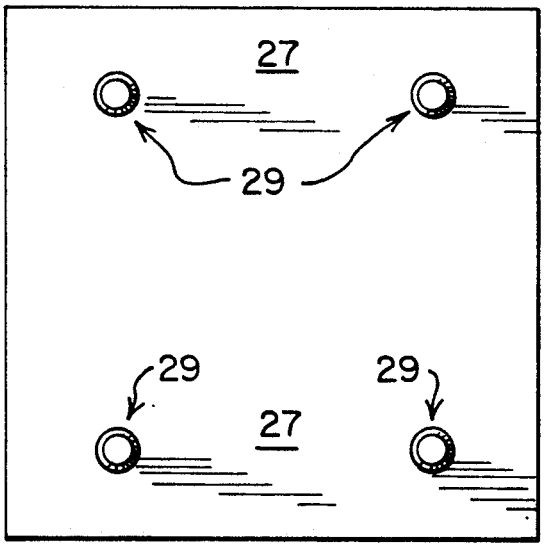
FIG. 4 is a fragmented, bottom plan view of the stove-top cover of FIG. 3.

As FIGS. 2–5 show, cover 21 further comprises abbreviated legs 29 that project downwardly from the slab lower surface 27. As FIG. 5 illustrates, each leg 29 has a generally cylindrical, somewhat tapered configuration and they are arranged on bottom 27 such that their cylindrical axes A will be in registration with the centers of the central openings 19 of the support frames 15 when cover 23 is utilized in a manner to be described. Referring again to FIG. 5, it is seen that each abbreviated leg 29 has a wooden core 31 that is secured to slab 23 by a screw 33. An elastomer sheath 35 of a suitable rubber or rubber-like material is applied over the wooden core 31. Sheath 35 is sized so as to be held in place by virtue of resiliently embracing the core 31, however, it is evident that it may also be suitable to adhere an elastomer sheath to the core 31 using a suitable adhesive. It is noted that an elastomer material is chosen for the sheath 35 because of its shock absorbing and dampening qualities, and because such material can be resiliently compressed into binding, releasable, frictional engagement with the support frame 15, when a leg 29 engages an opening 19.

When the stove 11 is not used for cooking, the cover 21 may be positioned over the stove-top as illustrated in FIG. 1 and then lowered to bring the abbreviated legs 29 into engagement with the openings 19 of the support frames 15, and a slight downward pressure will cause the legs to become properly seated in place. FIG. 5 illustrates leg 29 snugly engaging an opening 19. When cover 21 is installed in this manner, the weight of platform 23 will help hold the legs engaged within the central openings, which engagements also hold the support frames against vertical movement and vibration, as well as against lateral movement and vibration. Additionally, the installed cover 21 will then provide slab top 25 as a useful surface for, among other things, storing miscellaneous and sundry articles. When the stove is to be used for cooking, the cover 21 can be easily removed and put in storage.

While a particular embodiment of the invention has been described herein, it is not intended that the invention be limited thereto, since various modifications and changes may readily occur to those skilled in the art without departing from the invention. For example, in another variant of the invention the abbreviated legs 29 can be constructed entirely of a suitable elastomer polymeric material. Therefore, it is aimed to cover all such changes and modifications that fall within the true spirit and scope of the invention as defined in the claims which follow.

What is claimed is:

1. Cover for the top of a mobile vehicle stove, said stove having a plurality of burners, each burner having mounted therearound a rack for supporting cooking utensils over said burner and having a central opening therein, said cover comprising:

a. generally rectangular platform with a generally planar top surface and a bottom; and b. a plurality of leg members affixed to said platform bottom and projecting downwardly therefrom, each of said legs having a generally cylindrical configuration and a tapered portion and a cover of elastomer material, whereby said legs are adapted to be brought into releasably binding engagement with said central openings and to hold and support said platform and to hold said racks against vertical and lateral movement.

2. Cover as defined in claim 1 having four of said legs.

3. Cover as defined in claim 1 wherein each of said legs has a tapered upper portion and a cylindrical lower portion.

4. Cover as defined in claim 1 wherein said elastomer covers are adapted to be compressed when in engagement with said central openings.

5. Cover as defined in claim 4 wherein said elastomer covers are adapted to dampen vibrations.

6. Cover as defined in claim 1 wherein said legs are constructed entirely of an elastomer material.

7. Cover as defined in claim 1 wherein said platform has a weight sufficient to urge said legs downwardly into frictionally binding engagement with said central openings.

8. Cover as defined in claim 1 wherein said platform is composed of a relatively dense, non-metallic material.

* * * * *